US006346171B1

(12) United States Patent
Huu et al.

(10) Patent No.: US 6,346,171 B1
(45) Date of Patent: Feb. 12, 2002

(54) PAPER MAKING MACHINE USING SEPARATE METAL SCREENS FOR PRESS AND DRYER CYLINDERS

(75) Inventors: Tri Chau Huu, Heidenheim; Markus Oechsle, Bartholomä ; Robert Wolf, Herbrechtingen; Wolfgang Mayer; Karlheinz Straub, both of Heidenheim, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 08/998,593

(22) Filed: Dec. 22, 1997

(30) Foreign Application Priority Data

Dec. 30, 1996 (DE) ..... 196 54 434

(51) Int. Cl.[7] ..... D21F 7/00; D21F 5/02

(52) U.S. Cl. ..... 162/359.1; 34/116; 162/902; 162/375

(58) Field of Search ..... 162/358.2, 359.1, 162/902, 903, 375, 290; 34/116, 123

(56) References Cited

U.S. PATENT DOCUMENTS

| | | | | | |
|---|---|---|---|---|---|
| 1,470,675 | A | * | 10/1923 | Armstrong | 162/359.1 |
| 1,925,917 | A | * | 9/1933 | Chalon | 162/900 |
| 2,134,293 | A | * | 10/1938 | Webb | 162/903 |
| 2,437,254 | A | * | 3/1948 | Hill | 34/116 |
| 2,918,094 | A | * | 12/1959 | Freynik | 162/903 |
| 4,000,035 | A | * | 12/1976 | Schiel et al. | 162/306 |
| 4,251,928 | A | | 2/1981 | Rotar et al. | 34/116 |
| 4,874,469 | A | * | 10/1989 | Pulkowski | 162/358.2 |
| 5,178,732 | A | * | 1/1993 | Steiner et al. | 162/360.3 |
| 5,388,347 | A | * | 2/1995 | Kerttula et al. | 162/193 |
| 5,389,205 | A | * | 2/1995 | Pajula et al. | 162/210 |
| 5,820,731 | A | * | 10/1998 | Soderholm | 162/210 |

FOREIGN PATENT DOCUMENTS

| | | | | |
|---|---|---|---|---|
| DE | 560748 | | 10/1932 | |
| DE | 642993 | | 3/1937 | |
| DE | 6936412 | | 9/1969 | |
| EP | 54206 | * | 6/1982 | 162/902 |
| GB | 1377 | * | of 1906 | 162/358.2 |
| SE | 186793 | * | 12/1963 | 162/358.2 |
| SU | 436120 | * | 7/1974 | 162/358.2 |

* cited by examiner

*Primary Examiner*—Karen M. Hastings
(74) *Attorney, Agent, or Firm*—Greenblum & Bernstein P.L.C.

(57) ABSTRACT

Described is a machine for manufacturing a continuous web, in particular a paper or cardboard web, the machine having a number of rolls that may include press rolls, drying cylinders, suction rolls, or the like. At least one transport belt is guided with the web around the rolls and is characterized by the fact that a metallic screen is guided between the web and the respective roll surface. The metallic screen may be formed of metal, formed as a metallized drying screen, or formed from metal and synthetic threads.

11 Claims, 2 Drawing Sheets

PAPER MAKING MACHINE USING SEPARATE METAL SCREENS FOR PRESS AND DRYER CYLINDERS

CROSS-REFERENCE OR RELATED APPLICATION

The present application claims the priority under 35 U.S.C. § 119 of German Patent Application No. 196 54 434.3 filed on Dec. 30, 1996, the disclosure of which is expressly incorporated by reference herein in its entirety.

BACKGROUND OF THE INVENTION

1. Field of the Invention

The present invention relates to a machine for manufacturing a continuous web, in particular a paper or cardboard web.

2. Discussion of Background Information

Machines of this type typically include a plurality of rolls such as press rolls, drying cylinders, suction rolls or the like.

Machines of the type mentioned above are known. In the manufacturing of continuous webs, a number of rolls are used, for example: press rolls, drying cylinders, or suction rolls. The web is guided over the surface of the rolls with the aid of at least one transport belt, which is also denoted as a screen or felt. It is also known that at high speeds of operation, for example from over 1000 m/min to more than 2000 m/min, that the tendency of the web to adhere to the surface of the rolls of a manufacturing machine leads to web tears. At any rate, the quality of the finished web is negatively affected by the adhesion tendency.

SUMMARY OF THE INVENTION

According to the present invention, a machine has been developed for manufacturing a continuous web that does not exhibit the above-noted disadvantage.

This is accomplished by such a machine that includes a plurality of rolls, such as press rolls, drying cylinders, or suction rolls. The web is guided over the surface of the rolls by at least one transport belt. At least one screen, such as a metallic screen, is guided between the web and the respective roll surface. The metallic screen may be made either completely out of steel or other metal or formed as a metallized drying screen. Moreover, it is possible to form the screen of metal and synthetic threads. By guiding the screen between the web and the surface of the rolls, the adhesion tendency of the web is reduced. The embodiments that are referred to in the following generally use a metallic screen of the kind mentioned previously. In view of the above, the metallic screen of the present invention may consist essentially of metal.

A preferred embodiment of the machine is characterized in that a separate metallic screen is assigned to one, several, or all the rolls. In such an embodiment, a relatively uncomplicated screen construction is possible, so that construction expenditures can be reduced or limited.

Furthermore, a preferred embodiment of the machine is characterized in that the metal screen is usable in a drying section, in which the web, with the aid of at least one transport belt, is guided around one or more rolls that are designed as drying cylinders. Since the metal screen is guided directly on the surface of the drying cylinder or cylinders, an adhesion of the web to this surface is safely avoided.

Another preferred embodiment of the machine is one in which the metal screen is usable within the press section, in which the web, with the aid of at least one transport belt that is designed as a press screen, is guided over one or more rolls that are designed as press rolls. Other aspects of the present invention include, e.g., that a separate metallic screen may be assigned to at least one of the rolls; that each metallic screen may be guided such that the web is guided as it runs off the surface of a roll in a defined manner; that the surface of the metallic screen may be very finely structured; that the metallic screen may be porous; that the metallic screen can be heated, preferably shortly before the contact of the web; that at least one cleaning device may be provided for the metallic screen; and, that the metallic screen may have a thickness of less than approximately 1 mm, preferably less than about 0.1 mm.

Furthermore, the machine with the metallic screen in accordance with the present invention may be usable in a drying group of the machine, in which the web, with the aid of at least one transport belt, is guided around the rolls, which are designed as drying cylinders, and also, in which the web is guided through rolls that are designed as press rolls, where at least two of the press rolls define a press opening therebetween. The web and the metallic screen may be guided through one press opening or through two press openings.

According to another aspect of the present invention, the machine for manufacturing the continuous web includes a plurality of rolls, and at least one screen guided between the web and surfaces of the plurality of rolls. The machine may include a separate screen assigned to at least one of the rolls, and each screen may be guided such that the web is guided as it runs off the surface of a roll in a defined manner.

In accordance with a further aspects of the invention, at least one of the screens has a very finely structured surface, and, at least one screen is porous.

Additionally, the machine in accordance with the present invention may further include a heater positioned adjacent the screen, and may be located before a web contact point of the screen. The machine may also include at least one cleaning device for the screen. Other aspects of the present invention may include, e.g., the screen having a thickness of less than approximately 1 mm, preferably being less than about 0.1 mm.

Furthermore, the machine with the screen in accordance with the present invention may be usable in a drying group of the machine, in which the web is guided around the rolls, which may be designed as drying cylinders, and also in which the web is guided through rolls that are designed as press rolls, where at least two of the rolls define a press opening, or nip, therebetween. The web and the screen are guided through one press opening or through two press openings.

As noted above, the screen may be made of metal, or formed as a metallized drying screen. Moreover, it is possible to form the screen of metal and synthetic threads.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted drawings by way of non-limiting examples of preferred embodiments of the present invention, wherein same reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The machine described as follows is generally usable for the manufacturing of a continuous web. It is especially suitable for the manufacturing of a paper or cardboard web. In the first embodiment it may be assumed that, as an example, the depicted machine is a paper manufacturing machine.

Figure 1:
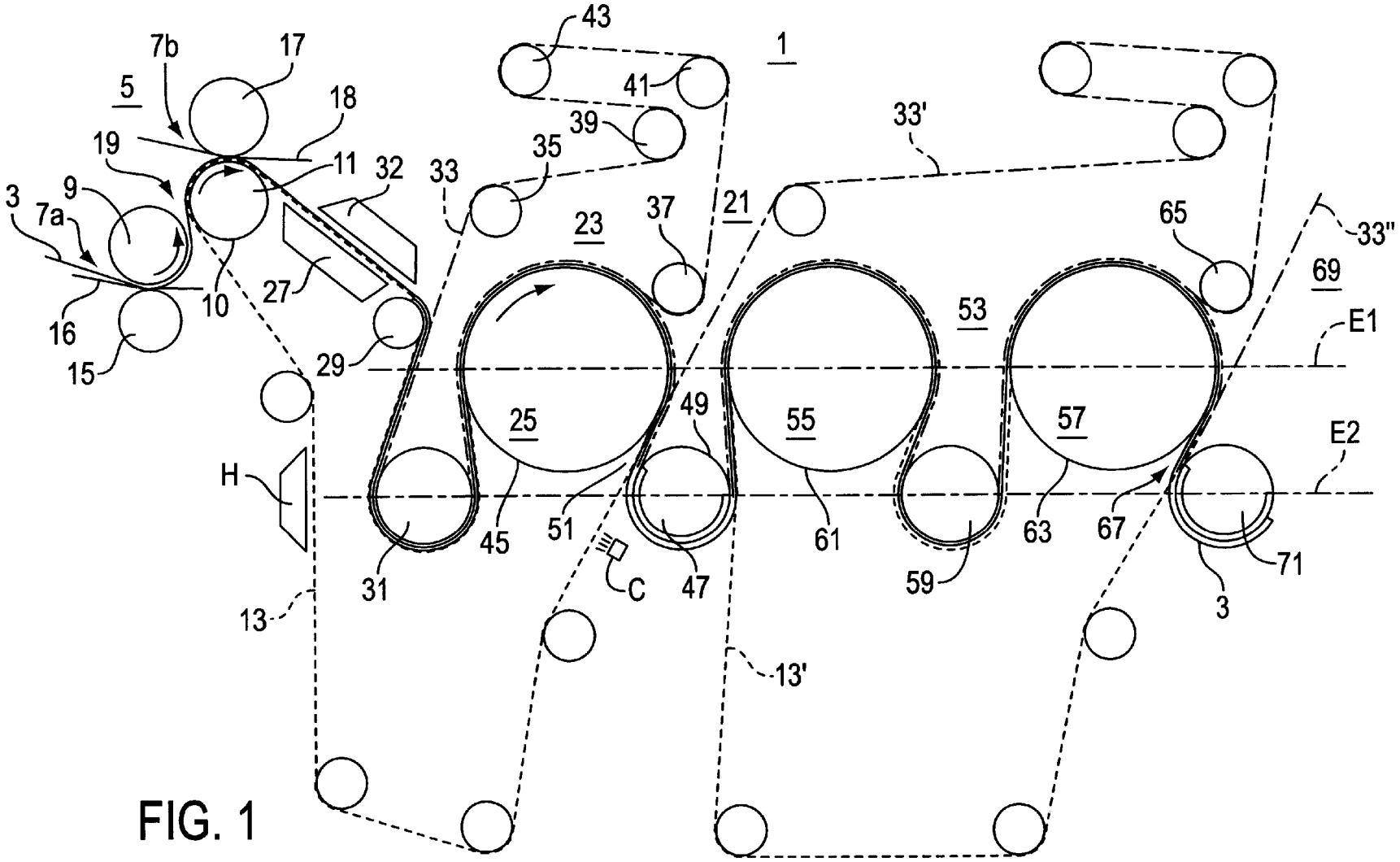
FIG. 1 shows a schematic diagram of a part of a first embodiment of a machine for the manufacturing of a continuous web.

In FIG. 1, a part of machine 1 is depicted, which serves in manufacturing of a web 3, such as a paper web. Web 3 is fed from left to right, that is, in machine run direction, through the machine over a number of rolls, which can provide various functions.

In a first part of the machine, a so-called press section 5, the web is guided through press nips (openings) 7*a* and 7*b*, which in this case are formed by two press rolls 9 and 11. The web runs over a peripheral area of the first press roll 9, which turns, e.g., counter-clockwise. It then runs through the press rolls and then lies on a peripheral area 10 of the surface of the second press roll 11, which, e.g., turns clockwise. A first metal screen 13 lies directly on the peripheral area 10 of the second press roll 11, over which the web 3 is guided. Thus, the web 3 does not come into direct contact with the peripheral area of the second press roll 11.

Cooperating with the first and second press rolls 9 and 11 are additional rolls 15 and 17, which are known in principle and will not, therefore, be described in any detail. It should be remembered that the additional rolls, in conjunction with the first and second press rolls, form press nips (openings) 7*a* and 7*b*, through which the web 3 is guided.

A first press felt 16 is guided between the first press roll 9 and the additional roll 15, and a second press felt 18 is guided between the second press roll 11 and the additional roll 17. The press felts run through the opening formed between the press rolls and the additional rolls, and in so doing it absorbs moisture from the web.

The first metal screen 13 is guided into the opening 19 located between press rolls 9 and 11. The second press roll 11 cooperates with the additional roll 17 such that the web 3 and the first metal screen 13 are guided together through the press opening 7*b*. Press roll 11, which is surrounded by the metal screen 13, should be able to absorb water and should include a porous, i.e., grooved or bored, roll surface.

The web 3 comes from the press section 5 into the so-called drying section 21, which can include several drying groups. The first drying group 23 includes a roll designed as a drying cylinder 25, over which the web is guided. The web 3 goes from the press section 5 over a suitable guiding device, which essentially extends over the width of the web, and in this case over a so-called transfer foil 27 and over a web guide roll 29 to a first deflection roll 31, and from there is guided onto the drying cylinder 25. Another auxiliary attachment 32, running over the web width, can be provided on the side of web 3 opposite the transfer foil 27. Auxiliary attachment 32 may be designed as an infra-red, steam, and/or hot-air heating unit or a profiling unit.

The web guide roll 29 is arranged within the closed loop of the first metal screen 13, so that the first metal screen 13 lies directly on a peripheral area of web guide roll 29, and web 3 is arranged above the first metal screen 13. A first transport belt 33, which is designed as a drying screen or a drying felt, is also guided on the first web guide roll 29. First transport belt 33 is also guided over the respective leading rolls 41, 43, 39 and 35 such that a closed loop is formed, whereby the first transport belt 33 is guided over the first deflection roll 31 and a peripheral area of the drying cylinder 25. The web 3 is sandwiched between the first metal screen 13 and the first transport band 33, and is therefore also safely guided in the vicinity of the transitional area between web guide roll 29 and the first deflection roll 31 as well as between the first deflection roll 31 and the drying cylinder 25. Thus, there are no free stretches.

With the guiding of the first metal screen 13 suggested here, the first deflection roll 31 lies outside, and the drying cylinder 25 lies inside, the loop formed by the first metal screen 13, so that the first metal screen therefore lies directly on a peripheral area 45 of the drying cylinder 25. The web 3 is pressed onto the peripheral area 45 by the first transport belt 33, so that a low-loss heat transfer from the peripheral area 45 of the heated drying cylinder to the web can take place. The first transport belt 33 is carried away from the drying cylinder over the guide roll 37 at an angle of contact of approximately 120 degrees, while the first metal screen 13 and the web 3 are guided further on the drying cylinder. Both are guided onto a second deflection roll 47, whereby a peripheral area 49 of the second deflection roll 47 and the peripheral area 45 of the first drying cylinder 25 are arranged at a distance to each other.

The web 3 is transferred by a so-called sandwich guidance in a transitional area between the drying cylinder 25 and the second deflection roll 47 by the first metal screen 13 and a second transport belt 33'. That means that the web 3 lies between two belts running in the same direction, through which it is held securely, so that a transverse shrinkage is minimal. At the same time it is ensured, through the first metallic screen 13 that is guided under tension, that the web 3 does not cling to the peripheral area 45 of the drying cylinder 25 in the nip 51, which is opening.

The second deflection roll 47 is a part of a second drying group 53, which is included in drying section 21. Both drying groups 23 and 53 have separate transport belts 33 and 33', which also, as noted previously, can be characterized as a drying screen or a drying felt. The second drying group 53 is comprised of two drying cylinders 55 and 57, the centers of which lie at an imaginary level E1, at which the central point of the first drying cylinder 25 is also arranged. The centers of the first and second deflection rollers 31 and 47 lie below this level, as do the centers of a further, third deflection roll 59, which is assigned to the second drying group 53, at a second level E2. A simple support is thereby created.

The web 3 moves in a meandering manner around the drying cylinders 55 and 57 and the deflection rolls 47 and 59 of the second drying group 53 and is thereby additionally supported by a second metal screen 13', which is guided over suitable guide rolls such that both drying cylinders 55 and 57 lie within the loop of the second metal screen 13', and the third deflection roll 59 lies outside of it. The second metal screen 13' is guided directly on peripheral surfaces 61 and 63 of drying cylinders 55 and 57 and is under a pre-tension, to prevent adhesion of the web to the peripheral surfaces 61 and 63. The second metal screen 13' removes the web 3 from the surfaces of the drying cylinders 55 and 57 to avoid adhesion.

In addition, the second transport belt 33' is guided by suitable guide rolls in a closed loop, whereby the second deflection roll 47 and the third deflection roll 59 lie within the loop and the drying cylinders 55 and 57 lie outside of the loop. Within the second drying group 53, the web 3, in the transitional areas between the deflection rolls and the drying cylinders, is sandwiched between the second transport belt 33' and the second metallic screen 13' so that no free stretches occur.

Over a suitable leading roll 65, the second transport belt 33' is taken from the peripheral area 63 of the drying cylinder 57, while the web 3 and the metal screen 13 continue to lie on its peripheral surface. In the area of a nip 67, which is opening, in which the second metal screen 13' and the web 3 are lifted from the peripheral surface 63 of drying cylinder 57, a transport band 33" of a subsequent drying group 69 is fed onto drying cylinder 57. At this point, the web 3 is securely sandwiched between the second metal screen 13' and the transport band 33", all of which are guided onto a fourth deflection roll 71 of the third drying group 69. Since the web 3 in the area of the fourth deflection roll 71, as well as in the area of the second deflection roll 47, is arranged externally of the respective deflection rolls and transport bands or belts, and therefore completely exposed to the centrifugal forces, these deflection rolls are preferably provided with suction device. Thus, for example, the web 3, by a vacuum on the peripheral area of the deflection rolls, is suctioned onto and guided securely by the deflection rolls, and web tears are avoided.

It becomes apparent from the description for FIG. 1, that the drying cylinder 25 of the first drying group 23 and the second press roll 11 of the press section 5 are arranged within the closed loop of the first metal screen 13. Within the loop of the second metal screen 13' lie, as noted, the drying cylinders 55 and 57 of the second drying group 53. It is in this point that the embodiment depicted in FIG. 2 of a machine 1 for the manufacturing of a web 3 is different. Corresponding parts are assigned corresponding reference numbers; in this respect, one can refer to the description for FIG. 1.

Figure 2:
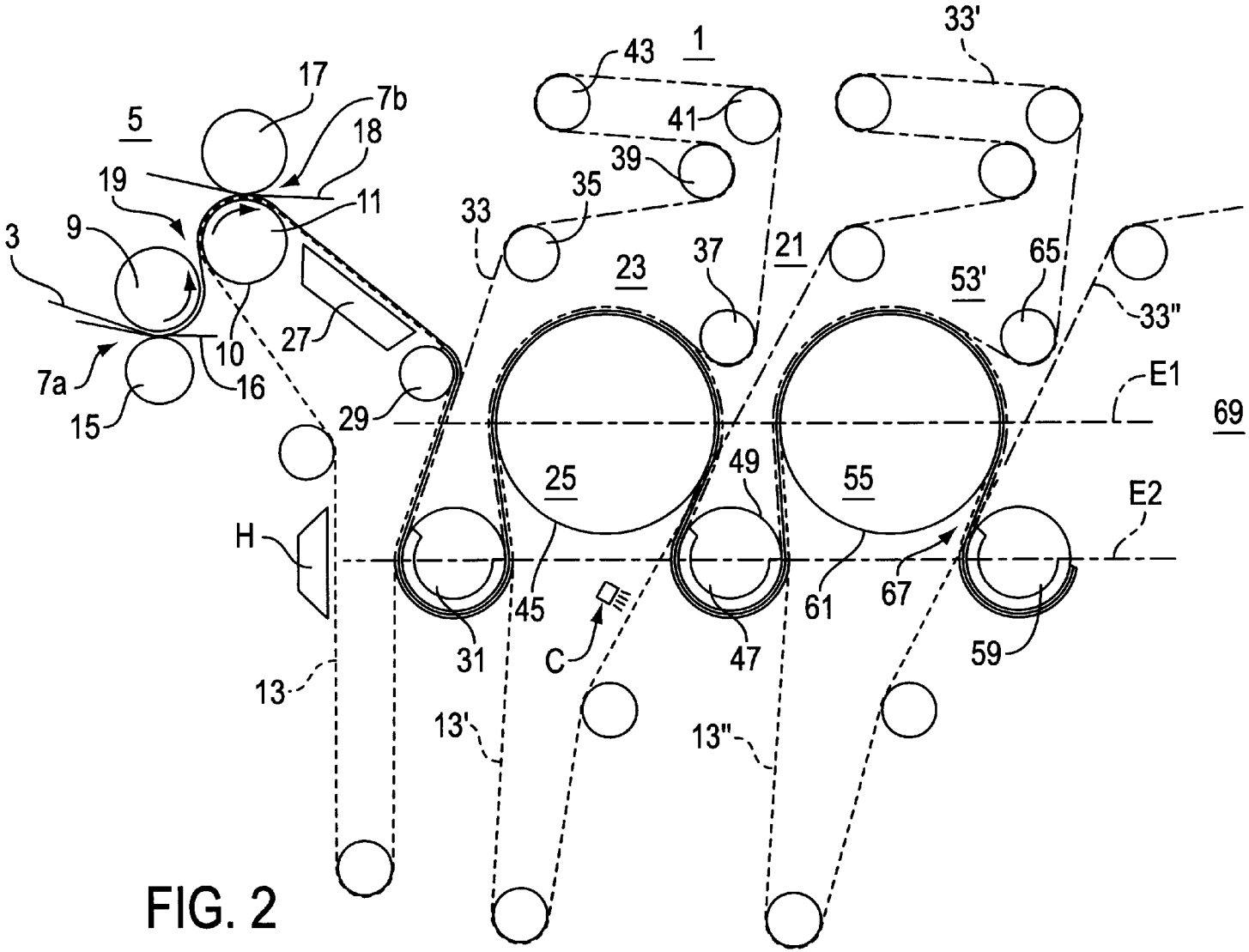
FIG. 2 shows a schematic diagram of a part of a second embodiment of a machine for the manufacturing of a continuous web.

The embodiment depicted in FIG. 2 distinguishes itself in that individual metal screens 13, 13', and 13" are respectively assigned to the second press roll 11 of the press section 5, the drying cylinder 25 of the first drying group 23, and the drying cylinder 55 of the second drying group 53'. It can be seen that in this case the drying group 53' is comprised here of only one drying cylinder 55, which, as with drying cylinder 25, is assigned its own transport belt 33' or a drying screen or drying felt. The first deflection roll 31 between the press section 5 and the first drying group 23 is provided with suction, as is the second deflection roll 47 between both drying groups 23 and 53'. Thus, the web 3, which lies externally of the first and second deflection rolls and the transport bands or belts, is held by a vacuum to the peripheral area of the respective deflection roll, and thereby stabilized. Correspondingly, the third deflection roll 59, which, as observed in machine run direction, is arranged behind the drying cylinder 55, is also designed with a suctioning capability in order to stabilize the circulating web 3, which is guided onto a drying cylinder within the successive drying group 69 not depicted here.

In view of the above and in view of FIG. 2, the metal screen 13 guides the web 3. Only one press roll 11 is within the metal screen 13. A press felt 18 guides the web 3 which is between and contacting the metal screen 13 and the press felt 18 in at least one location.

The special guidance of the metal screens 13, 13', and 13" depicted in FIG. 2, which includes only one press roll or one drying cylinder within each closed screen loop, creates an especially uncomplicated screen guiding that enables high machine running speeds.

In the free transitional areas, in which the web 3 does not lie on the surface of a roll or a cylinder, it is guided, in sandwich fashion, between a metal screen and a transport belt. Thus, during the transfer from press section 5 and the first drying group 23, the web 3 runs between the web guide roll 29 and the first deflection roll 31, sandwiched between the first transport belt 33 and the first metallic screen 13. Between the deflection roll 31 and the drying cylinder 25, the web 3 is guided between the first transport belt 33 and the second metal screen 13'. A guidance of the web 3 between the drying cylinder 25 and the successive second deflection roll 47 proceeds by means of belts that run in the same direction, specifically through the second metal screen 13' and through the second transport belt 33'. From the second deflection roll 47 the web 3 is carried between the transport belt 33' and the third metallic screen 13" onto the drying cylinder 55.

In view of the above and in view of FIG. 2, the web 3 is transferred from the first metallic screen 13 to drying cylinder screen 13' in a closed draw. The web 3 is supported by the first metallic screen 13, a transport belt 33, and one of the drying cylinder screens 13' in the closed draw. The web 3 is sandwiched between the first metallic screen 13 and the transport belt 33 in the closed draw.

It is clear from this that certain rolls of machine 1 as depicted in FIG. 2, specifically the second press roll 11 and the drying cylinders depicted as drying cylinders 25 and 55, are each assigned their own metal screens, respectively 13, 13', and 13", each of which is guided in a closed loop. In addition, guide rolls are, by a known method, inserted, which on one hand provides guidance of, and on the other hand provides tension to, the metal screen, which will not be discussed any further. Correspondingly, the transport belts 33 and 33', each of which are assigned to a single drying cylinder 25 or 55, are guided in a closed loop, within which lie the deflection rolls and some of the guide rolls, so that it is ensured that no free stretches develop, within which the web can be guided between two rolls without any support.

From the descriptions for FIGS. 1 and 2 it becomes clear that, in the area of press section 5 as well as in the area of drying section 21, metal screens can be inserted, which provide the desired guiding of the web.

Within press section 5, the first metal screen 13, which serves as a transport belt, ensures that the web 3 does not follow the press felt, which is guided together with web 3 between the first press roll 9 and the additional press 15, or between the second press roll 11 and the additional roll 17. The web 3 runs on the point of separation of the web and press felt with the metallic screen, which prevents the web from running with the press felt. Through this special guiding of the web, re-moistening of the web is reduced. The running of the web with the metal screen is based on the fact that rear ventilation on the press felt is greater than on the side of the metal screen.

From FIGS. 1 and 2 it is evident that the first metal screen 13 can also be used as a transport belt between the press section 5 and the drying section 21. This enables a web guidance free of stretches, through which the transverse profile of the mechanical web qualities are improved.

FIGS. 1 and 2 easily demonstrate that the metal screen can be used especially well in a drying section 21 of a machine 1 for manufacturing a continuous web 3, since in the areas where an adhesion of the web to the surface of a roll may occur, for example to a drying cylinder, a metallic screen lifts the web from the peripheral area of the drying cylinder and subjugates it to restricted guidance, so that adhesions are eliminated. Through the restricted guidance of the web with the aid of a metallic screen, a jamming-up of rolls within a machine for manufacturing a web can be safely avoided. In many cases the number of scrapers inside the drying sections, which serve to remove the web and clean the surface, can be reduced.

In every case, the metallic screen is preferably of a very thin design. The thickness lies in a range of under 1 mm. Preferred metallic screens have a thickness of approximately 0.1 mm. Screens have been employed, however, that were only 0.08 mm thick. Such thin metallic screens present almost no hindrance to the heat transfer from drying cylinders to the web. The metallic screens can be designed to be porous, so that they do not hinder evaporation from the web. Due to the porosity of the metal screen, an application directly in the area of the peripheral area 10 of the second press roll is also possible.

The preferred surface of the metallic screen is very finely structured, so that a marking of the web is avoided. A certain microstructure on the surface of the metallic screen is advantageous in that frictional engagement between the metal screen and the web can be achieved, in which, especially in the sandwich guidance, that is, while guiding the web between two belts running at equal speeds, the transverse shrinkage of the web is effectively reduced.

Finally, it is also possible to heat the metallic screen, preferably immediately before picking up on the web, in order to ensure a defined temperature gradient, especially in the drying section 21. In FIGS. 1 and 2, a heater H is shown merely for example.

On the whole it becomes clear that the web is guided between the metal screen and the surface of individual rolls in order to ensure a defined course of the web. This is advantageous in the press section to remove the web from a press felt and to forward it in a defined direction, without the use of additional suction devices. These guiding characteristics can be achieved through specific settings of the felt porosity and the metal screen.

Further, due to the metal belt, which was removed and was under tension from the peripheral surface of a roll, for example from the surface of a drying cylinder, it can be ensured that the web does not adhere to, and jam, the drying cylinder.

Because of these conditions, i.e. the directed guidance of the web within the machine 1, very high machine running speeds can be reached without reducing machine operational security.

Conventional cleaning devices C can be provided for the metal screen, so that no adhesions arise on the surface of the metal screen that could have an adverse effect on the surface of the web.

The advantages of the metal screen can be achieved regardless of whether the screen is made completely of metal or whether a conventional drying screen is metallized, or whether a screen with metal and synthetic threads is used as a metal screen.

The advantages of a metallic screen can be employed with a machine for manufacturing a continuous web, especially in that a metal screen is assigned to each roll on which the adhesion tendency of the web is especially great. It is therefore unnecessary to assign such a metal screen to each roll of a machine for manufacturing a continuous web. It is, however, also possible, if desired, to equip suction rolls or other rolls of a machine for manufacturing a web with metal screens.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A web machine system, comprising:

a web;

a plurality of drying cylinders for guiding the web in a path;

each of the plurality of drying cylinders has its own drying cylinder screen comprising metal for guiding the web in the path, and each of the plurality of drying cylinders is within a closed loop of its own screen;

a plurality of rolls for guiding the web prior to the plurality of the drying cylinders, the plurality of rolls comprise at least one press roll, and the web being guided through at least one press nip formed between at least one cooperating roll and the at least one press roll;

an additional metal screen which is guided with the web through the at least one press nip;

a heater positioned adjacent to the additional metal screen, the heater being located before a web contact point of the additional metal screen;

the web being transferred from the additional metal screen to one of the drying cylinder screens in a closed draw.

2. The web machine system of claim 1, wherein the plurality of rolls form two press nips through which the web is guided.

3. The web machine system of claim 1, wherein each screen comprises a microstructure for providing a frictional engagement between the screen and the web.

4. The web machine system of claim 1, wherein each screen is porous.

5. The web machine system of claim 1, further comprising at least one cleaning device for at least one of the screens.

6. The web machine system of claim 1, wherein at least one of the screens has a thickness of less than about 1 mm.

7. The web machine system of claim 1, wherein at least one of the screens has a thickness of less than about 0.1 mm.

8. The web machine system of claim 1, wherein the web comprises one of paper and cardboard.

9. The web machine system of claim 1, wherein at least one of the screens consists essentially of metal.

10. The web machine system of claim 1, wherein the web is supported by the additional metal screen, a transport belt, and the one of the drying cylinder screens in the closed draw.

11. The web machine system of claim 10, wherein the web is sandwiched between the additional metal screen and a transport belt in the closed draw.

* * * * *